US005385803A

United States Patent [19]

Duff et al.

[11] Patent Number: 5,385,803

[45] Date of Patent: Jan. 31, 1995

[54] AUTHENTICATION PROCESS

[75] Inventors: James M. Duff, Mississauga; H. Bruce Goodbrand, Hamilton, both of Canada; David L. Hecht, Palo Alto, Calif.

[73] Assignee: Xerox Corporation, Stamford, Conn.

[21] Appl. No.: 73

[22] Filed: Jan. 4, 1993

[51] Int. Cl.[6] ..... G03G 9/093

[52] U.S. Cl. ..... 430/138; 430/10

[58] Field of Search ..... 430/110, 109, 106, 138, 430/10

[56] References Cited

U.S. PATENT DOCUMENTS

| | | | |
|---|---|---|---|
| 3,898,171 | 8/1975 | Westdale | 252/62.1 P |
| 4,308,327 | 12/1981 | Bird et al. | 430/15 |
| 4,442,194 | 4/1984 | Mikami | 430/137 |
| 4,539,284 | 9/1985 | Barbetta et al. | 430/110 |
| 4,543,308 | 9/1985 | Schumann et al. | 430/21 |
| 4,699,866 | 10/1987 | Naoi et al. | 430/138 |
| 4,728,984 | 3/1988 | Daniele | 355/6 |
| 4,777,510 | 10/1988 | Russel | 355/7 |
| 5,035,970 | 7/1991 | Hsieh et al. | 430/138 |
| 5,107,130 | 4/1992 | Frese | 250/556 |

OTHER PUBLICATIONS

Xerox Disclosure Journal, vol. 13, No. 4, Jul./Aug. 1988, "Copy Sheet Size and Weight Sensing", Norman D. Robinson, Jr.

*Primary Examiner*—John Goodrow
*Attorney, Agent, or Firm*—E. O. Palazzo

[57] ABSTRACT

A process for the authentication of documents which comprises generating developed documents in an electophotographic apparatus, or in a laser printer with an encapsulated toner comprised of a core comprised of polymer, an optional pigment, and an infrared emitting component, and thereover a polymeric shell; and subjecting the document to an infrared reader whereby the infrared component is detected spectroscopically.

24 Claims, No Drawings

AUTHENTICATION PROCESS

BACKGROUND OF THE INVENTION

The present invention is directed to processes, and more specifically to processes wherein a component of the toner selected for the development of images can be detectable, especially by a reader that is sensitive to infrared light. In one embodiment, the process of the present invention comprises the generation of documents, such as tickets like tickets to sports activities, with a toner that contains an infrared emitting component or a component that fluoresces in the infrared spectral region, such as cyanine dyes, like tricarbocyanine dyes, certain phthalocyanines, and oxazine dyes. The aforementioned toner usually contains the infrared light emitter dissolved or finely dispersed in the core resin thereof. An example of a toner that may be selected is comprised of a core particle comprised of a polymer, an infrared emitter component, and optionally, a magnetic or colored pigment, flow aids and charge control additives and thereover a polymeric shell preferably prepared by interfacial polymerization.

Illustrated in U.S. Pat. No 5,208,630, the disclosure of which is totally incorporated herein by reference, are processes for the authentication of documents, such as tickets, credit cards, and the like, by generating these documents with a toner containing an infrared light absorbing component, which compositions are detectable when exposed to radiation outside the visible wavelength range, and more specifically, e wavelength of from between about 650 to 950 nanometers. In one embodiment of the copending application, there is disclosed a process for the authentication documents which comprises generating developed documents in an electrophotographic apparatus, or in e laser printer with toner comprised of a polymer, a pigment or pigments, an infrared absorbing component, and optionally thereover polymeric shell; and subsequently subjecting the document to an infrared reader whereby the infrared absorbing component is detected spectroscopically. The developed documents can be formed from latent electrostatic images in various known imaging apparatuses, such as the Xerox Corporation 5090, and thereafter developed with the toners illustrated herein, followed by fusing. Examples of infrared absorbing components disclosed in the copending application include those that absorb infrared light, such as metal phthalocyanines, like vanadyl phthalocyanines, dihydroxygermanium phthalocyanines and copper phthalocyanines, metal free phthalocyanines, such as x-metal free phthalocyanines, present in various effective amounts of, for example, from between about 0.5 and about 10, and preferably from between about 1 and about 8 weight percent of the toner.

Illustrated in U.S. Pat. No. 5,225,900, the disclosure of which is totally incorporated herein by reference, is a process for controlling a reproduction system comprising the steps of scanning an image to detect at least one taggant in at least one marking material forming said image; and issuing instructions to said reproduction system, wherein said instructions cause said reproduction system to take an action selected from the group consisting of (a) prohibiting reproduction of those portions of said image formed by said marking material containing at least one predetermined detected taggant, and reproduction of all other portions of said image; (b) prohibiting reproduction of any part of said image upon detecting of at least one predetermined taggant; (c) reproducing only those portions of said image formed by said marking material containing at least one predetermined taggant; (d) reproducing portions of said image formed by said marking material containing at least one predetermined taggant in a different manner from that in which said system reproduces portions of said image formed by said marking material not containing said at least one predetermined taggant; and (e) identifying a source of said image on the basis of detection of at least one predetermined taggant. It is indicated in this patent application that taggants may also provide security for important documents. The system of the copending application is capable of identifying documents (as well as marking materials) containing taggants which may be present in the toner or ink used to create an image on the document. Thus, copies made using such toner or ink doped with taggant can be readily identified. This can permit subsequent identification of the source of an image, generally by type of machine (for example for statistical data gathering) or, more specifically, by facility where a copy was made or even by the specific machine unit in which a copy was made (like for document tracking). Further, according to the copending application documents or portions thereof may also be made that are incapable of being copied by using tagged marking materials for at least the portion of the document for which protection is desired. The identification of a predetermined taggant may signal the system to prevent scanning, storing or developing operations of the whole document or areas where the particular taggant is present.

Illustrated in U.S. Pat. No. 5,082,757, the disclosure of which is totally incorporated herein by reference, are encapsulated toners comprised of a polymer binder, pigment or dye, and thereover a hydroxylated polyurethane shell, and which shell has the ability to effectively contain the core binder and prevent its loss through diffusion and leaching process. Specifically, in one embodiment there are provided in accordance with the copending application encapsulated toners comprised of a core containing a polymer binder, pigment or dye particles, and thereover a hydroxylated polyurethane shell derived from the polycondensation of a polyisocyanate and a water-soluble carbohydrate such as a monosaccharide, a disaccharide or the derivatives thereof with the polycondensation being accomplished by the known interfacial polymerization methods. Another specific embodiment of the copending application is directed to pressure fixable encapsulated toners comprised of a core of polymer binder, magnetic pigment, color pigment, dye or mixtures thereof, and a hydroxylated polyurethane shell, and coated thereover with a layer of conductive components, such as carbon black. There is indicated in this copending patent application that encapsulated cold pressure fixable toner compositions are known. Cold pressure fixable toners have a number of advantages in comparison to toners that are fused by heat, primarily relating to the utilization of less energy and enabling the use of heatless instant-on imaging apparatus, since the toner compositions selected can be fixed without application of heat.

In a patentability search report for the aforementioned copending patent application,: the following prior art, all U.S. patents, was recited: U.S. Pat. No 4,442,194 which discloses encapsulated toners with shells comprised of substances (A) and (B), see column 3 for example, wherein (A) can be an isocyanate and (B) can be an active hydrogen containing compound, see column 4, such as polyols, water, sorbitol, and the like, see column 5; a similar teaching is present in U.S. Pat. Nos. 4,699,866; 3,898,171, which discloses an electroscopic powder formulated with sucrose benzoate and a thermoplastic resin, see for example column 2; and U.S. Pat. Nos. 4,465,755 and 4,592,957 as being of possible background interest.

SUMMARY OF THE INVENTION

It is an object of the present invention to provide processes for the generation of images on a number of documents.

It is another object of the present invention to provide encapsulated toners with infrared dye emitters.

It is yet another object of the present invention to provide security documents, such as tickets, identification badges, passes, negotiable securities, and the like with encapsulated toners containing a component that emits infrared light, that is with a wavelength of from between about 700 to about 1,500 nanometers when said component is irradiated with light of a shorter wavelength of from about 250 to 1,400 nanometers.

It is still another object of the present invention to provide processes-that prevent the duplication of documents, including security documents, like tickets, credit cards, and the like by employing encapsulated toners with core containing infrared dyes detectable by a sensor that detects wavelengths invisible to the human eye, such as an infrared flourescence detector or reader.

Another object of the present invention is to provide processes for determining the authenticity of documents, such as tickets, credit cards, security badges, and the like by employing for the generation thereof encapsulated toners with certain core infrared dyes, detectable by a sensor that detects wavelengths invisible to the human eye, such as an infrared detector.

In yet another object of the present invention there are provided covert document authentications with colored toners, including encapsulated toners possessing infrared luminescence characteristics.

Further, in another object of the present invention there are provided invisible toners which provide invisible images on documents and covert document authentication processes thereof.

Moreover, in another object of the present invention there are provided covert document authentication processes wherein selected areas, or words of documents although not distinguished from the remainder of the document by the eye are detectable by, for example, an infrared device, thereby enabling security or special coding of the document. The dyes selected in embodiments are those that absorb ultraviolet visible or near infrared light, that is, for example, from about 250 nanometers to about 1,000 nanometers, and fluoresce in the infrared region of the light spectrum, that is, for example, from about 700 to about 1,500 nanometers.

It is still another object of the present invention to provide encapsulated toner compositions and toners free of encapsulation that can provide a means for placing coded information on a document, and which compositions can be selected for trilevel color imaging processes.

These and other objects of the present invention can be achieved by providing processes for the authentication of documents. In embodiments of the present invention, there are provided processes for the authentication of documents, such as tickets, credit cards, identification badges and the like, by generating these documents with toner containing certain infrared emitting components, which compositions are detectable when exposed to radiation in the ultraviolet, visible and near infrared wavelength range, and more specifically, a wavelength of from between about 250 to about 1,000 nanometers. Also, there are provided with the present invention infrared encapsulated toner compositions, and toners free of encapsulation.

In one embodiment, the present invention is directed to a process for the authentication of documents which comprises generating developed documents in an electrophotographic apparatus, or in a laser printer with an encapsulated toner comprised of a core comprised of a polymer, a pigment or pigments, and an infrared emitting component, which component absorbs visible light and fluoresces in the infrared region of the light spectrum, and optionally thereover a polymeric shell; and subsequently subjecting the document to a device such as a spectrometric scanner which irradiates the document with a light which is absorbed by the infrared emitting component and detects the emitted infrared fluorescence from the same component using a detector which is sensitive to the particular wavelength of the emitted radiation. In general, such devices comprise a light source encompassing a specific wavelength range for irradiation of the document which could be from about 250 to about 1,000 nanometers for the processes of the present invention, an infrared responsive photodetector or video camera which would respond to light of a wavelength from about 700 to about 1,500 nanometers and, immediately in front of the detector, a barrier filter which would prevent the irradiating light from reaching the photodetector but would allow the emitted light from the sample (of wavelength greater than 700 nanometers) to pass through to the photodetector, such as fluorescent light detection scanning devices used to detect, for example, invisible fluorescent postal codes on mail for automatic sorting. For the present invention, in embodiments a device using the same principals but adapted to detect longer wavelength of emitted light, for example from about 700 to about 1,500 nanometers can be selected. The developed documents can be formed from latent electrostatic images in various known imaging apparatuses, such as the Xerox Corporation 5090, and thereafter developed with the encapsulated toners illustrated herein, followed by fusing.

In one embodiment, the process of the present invention comprises creating a document toned completely or only in specific areas with the infrared emitting toner illustrated herein. The authenticity of this document may then be confirmed by measuring the emitted light from the document with a scanner such as a known diode array detector. By comparing the intensity of light reflected from the surface of the printed document at the wavelength corresponding to emission wavelength of the infrared emitting component with either background emission or emission from toned areas not containing the emitting dye, the presence of the infrared active material may be confirmed and the authenticity of the document affirmed.

The toners of the present invention can be comprised of a core comprised of a polymer, pigment, including colored pigments such as red, blue, green, yellow, magenta and cyan, and an infrared dye component which emits infrared light, and polymeric shell.

The toners selected can be prepared by an encapsulation process in which a core monomer composition is surrounded by a polymeric shell. Illustrative examples of core monomers, which are subsequently polymerized after microcapsule shell formation, and are present in an effective amount of from, for example, about 15 to about 90 weight percent, and preferably from about 20 to about 50 weight percent, include acrylates, methacrylates, olefins including styrene and its derivatives, and the like. Specific examples of core monomers include methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, substituted styrenes, other substantially equivalent addition monomers, and other known addition monomers, reference for example U.S. Pat. 4,298,672, the disclosure of which is totally incorporated herein by reference, and mixtures thereof.

Various known core pigments that can be selected include magnetites, such as Mobay magnetites MO8029 TM, MO8060 TM; Columbian MAPICO BLACKS TM and surface treated magnetites; Pfizer magnetites CB4799 TM, CB5300 TM, CB5600 TM, MCX636 TM; Bayer magnetites BAYFERROX 8600 TM, 8610 TM; Northern Pigments magnetites, NP-604 TM, NP-608; TM Magnox magnetites TMB-100 TM or TMB-104 TM; and other similar black pigments, including mixtures of these pigments with other colored pigments illustrated herein. As colored core pigments there can be selected cyan, magenta, yellow, red, green, brown and mixtures thereof. Specific examples of pigments include RED LAKE C TM, HELIOGEN BLUE L6900 TM, D6840 TM, D7080 TM, D7020 TM, PYLAM OIL BLUE TM and PYLAM OIL YELLOW TM, PIGMENT BLUE 1 TM available from Paul Uhlich & Company, Inc., Pigment Violet 1, PIGMENT RED 48 TM, LEMON CHROME YELLOW DCC 1026 TM, E.D. TOLUIDINE RED TM and BON RED C TM available from Dominion Color Corporation, Ltd., Toronto, Ontario, NOVAPERM YELLOW FGL TM, HOSTAPERM PINK E TM available from Hoechst, CINQUASIA MAGENTA TM available from E. I. DuPont de Nemours & Company, and the like. Examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-4-(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 2700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned pigments can be incorporated into the microencapsulated toner compositions of the present invention in various effective amounts. In one embodiment, the pigment particles are present in the toner composition in an amount of from about 2 percent by weight to about 65 percent by weight calculated on the weight of the dry toner.

Surface additives that can be selected to, for example, improve the surface characteristics of the toners in embodiments of the present invention include, for example, metal salts, metal salts of fatty acids, colloidal silicas, mixtures thereof and the like, which additives are usually present in an amount of from about 0.1 to about 5 weight percent, reference U.S. Pat. 3,590,000; 3,720,617; 3,655,374 and 3,983,045, the disclosures of which are totally incorporated herein by reference. Preferred surface additives include zinc stearate and AEROSIL R972 ®.

Examples of infrared emitting core components selected and present in various effective amounts of, for example, from between about 0.001 and 5.0, and preferably from between about 0.01 and about 2 weight percent of the toner, include 3,3'-diethylthiatricarbocyanine, 5,5'-dichloro-11-diphenylamino-3,3'-diethyl- 10, 12'-ethylene-thiatricarbocyanine perchlorate, and anhydro-11-(4-ethoxycarbonyl-1-piperazinyl)-10,12-ethylene-3,3,3',3'-tetraethyl- 1,1 '-di(3-sulopropyl)-4,5,4',5'-dibenzoindotricarbocyanine hydroxide, and magnesium phthalocyanines, certain azine dyes and chlorophylls such as bacteriochlorophyll a, laser dyes, such as those described in the textbook *Laser Dyes* by M. Maeda, Academic Press, 1984, the disclosure of which is totally incorporated herein by reference, which can be selected for their acceptable light stability and efficient fluorescence.

The aforementioned toner compositions of the present invention can be prepared by a number of different processes as indicated herein and by other known processes, including a chemical microencapsulation process which involves a shell forming interfacial polycondensation and an in situ core binder forming free radical polymerization. The microencapsulation process is comprised, for example, of first thoroughly mixing or blending a mixture of core binder monomer or monomers, a free radical initiator, a colorant or mixture of colorants including magnetites, the infrared emitting component, diisocyanates such as toluene diisocyanate or polyisocyanates; dispersing the aforementioned well blended mixture by high shear blending into stabilized microdroplets of specific droplet size and size distribution in an aqueous medium containing a suitable stabilizer or emulsifying agents, and wherein the volume average microdroplet diameter can be desirably adjusted to be from about 5 microns to about 30 microns with the volume average droplet size dispersity being less than 1.4 as inferred from the Coulter Counter measurements of the microcapsule particles after encapsulation; subsequently subjecting the aforementioned dispersion to the shell forming interfacial polycondensation by adding a diamine such as Dytek A, 1.5-diamino-2-methylpentane a polyol or polyols selected preferably from low molecular weight diols such as 1,4-dihydroxybutane; and thereafter initiating the core binder-forming free radical polymerization within the newly formed microcapsules with heat. The shell forming interfacial polycondensation is generally executed at ambient temperature, about 25° C., but elevated temperatures may also be employed depending on the nature and functionality of the shell components used. For the core binder forming free radical polymerization, it is generally accomplished at temperatures from ambient temperature to about 100° C., and preferably from ambient temperature to about 85° C. In addition, more than one initiator may be utilized to enhance the polymerization conversion, and to generate the desired molecular weight and molecular weight distribution.

Known polymeric shells as the encapsulating component can be selected, which polymers, such as polyesters, polyurethanes, polyureas, and the like, are preferably formed by interfacial polymerization. Examples of shell polymers include the reaction product of a diamine and a diisocyanate, such as DESMODUR W® [bis-[4-isocyanatocyclohexyl]methane]and DYTEK A® (1,5-diamino-2-methylpentane), TMXDI® (tetramethylxylyldiisocyanate) and DYTEK A®, or a mixture of DESMODUR W® (50.3 weight percent), DYTEK A® (11.2 weight percent) and JEFFAMINE 400 ® (38.5 weight percent) present in the amount of about 1 to about 40 weight percent, and preferably in an amount of from about 10 to about 20 weight percent of the toner.

Illustrative examples of free radical initiators that can be selected include azo compounds such as 2-2'-azodimethylvaleronitrile, 2-2'-azoisobutyronitrile, azobiscyclohexanenitrile, 2-methylbutyronitrile, mixtures thereof, and other similar known compounds with the quantity of initiators being, for example, from about 0.5 percent to about 10 percent by weight of core monomers. Stabilizers selected include water soluble polymeric surfactants such as poly(vinyl alcohols), partially hydrolyzed poly(vinyl alcohols), hydroxypropyl cellulose, and methyl cellulose with a stabilizer to water ratio of from about 0.05 to about 0.75 for example.

The encapsulated toner compositions selected for the present invention in embodiments are mechanically stable and possess acceptable shelf life stability. For example, in embodiments they do not suffer from premature rupture, and are nonblocking and nonagglomerating.

Also, the toner compositions can be rendered conductive with, for example, a volume resistivity value of from about $10^3$ ohm-cm to about $10^8$ ohm-cm by adding to the toner surface thereof components such as carbon blacks, graphite, and other conductive components such as tin oxide. The aforementioned conductive toner compositions are particularly useful for the inductive development of electrostatic images.

The infrared light emitting component can be combined with the core materials prior to encapsulation and polymerization as illustrated herein. For conventional melt blended and jetted toner formulations, the infrared component can be incorporated together with pigment and other optional additives. The infrared emitting component can also be introduced into the final toner by a post treatment, such as precipitation from solution using, for example, addition of a nonsolvent to a mixture of toner in a solution of the dye which would cause the dye to precipitate and coat the toner surface. Alternatively, the dye could be introduced to the toner by a sorption process in which a solution of the infrared emitting dye in a solvent such as acetone or trichloroethane is formed into a suspension of the toner in water. In this process, the dye solution is adsorbed by the toner particles as the dye solvent dissolves into the toner resin. Subsequent to this sorption treatment, the toner can be separated from the water and warmed gently to remove the dye solvent. The toner can also be suspended in a solution of dye in a solvent such as, for example, water or alcohol, or mixtures thereof and the resultant suspension could be spray dried to isolate the toner which would be surface coated with the infrared emitting component.

In embodiments, the processes of the present invention can be selected with toners free of encapsulation, such as those comprised of resin particles, pigment particles like phthalocyanines, rhodamines, and magnetic iron oxides, and the infrared emitting component.

The following Examples are being submitted to further define various species of the present invention. These Examples are intended to be illustrative only and are not intended to limit the scope of the present invention.

EXAMPLE I

Encapsulated Toner Preparation:

An IR fluorescent toner was prepared by the technique of dye sorption in the following manner:

A colorless in situ toner was formulated using the known encapsulated approach as follows. A core monomer mixture comprised of 126.4 grams of n-laurylmethacrylate and 154.6 grams of styrene was combined with 38.8 grams of the shell forming monomer DESMODUR W® [bis-(4,4'-diisocyanatocyclohexyl)methane]and 3.34 grams each of three free radical initiators, VAZO 52® [2,2'-azobis(2,4-dimethylvaleronitrile], VAZO 67® [2,2'-azobis(2-methylbutyronitrile)], and VAZO 88 ®[1,1'azobis(cyclohexanecarbonitrile) This organic phase was then dispersed in 934 grams of a continuous aqueous phase, 1 percent by weight in TYLOSE® and 0.06 percent by weight in sodium dodecylsulfate. Homogenization was then effected by a Brinkmann polytron operated at 10,000 rpm for 90 seconds. Interfacial polymerization of the shell was then commenced by a slow 30 minute addition of 17.4 grams of the diamine, DYTEK A® (2'methyl-1,5-diaminopentane). After allowing one hour at room temperature, 25° C., for shell formation, the core was then allowed to polymerize at 65° C. for 2 hours then at 85° C. for a further 3 hours. The resulting toner batch was then cooled to room temperature and the resulting particles isolated by centrifugation at 3,000 rpm for 15 minutes. The encapsulated toner particles were then washed with warm water and reisolated by centrifugation. The washing sequence was repeated a total of three times. The particles were then dried by freeze drying. They had the following physical properties:

Core: styrene (55)/n-lauryl methacrylate (45), $M_n$ 20,000, $M_w$ 214,000

Shell: 20 weight percent of DESMODUR W-DYTEK TM, a polyurea.

As determined by a Coulter Counter, the average particle size was 6.0 microns and the GSD (size distribution) was 1.38.

EXAMPLE II

Encapsulated Color Toner Preparation:

A yellow encapsulated toner was prepared as follows. A 6 gram charge of PALIOTOL YELLOW K0961HD ® (Pigment Yellow 138) in 114 grams of a monomer mixture comprised of 58 percent n-butylmethacrylate, 29 percent styrene, and 13 percent n-laurylmethacrylate, was milled for 8 hours in an attritor to reduce pigment particle size. A milling yield of 110.3 grams was obtained. A shell forming diisocyanate was then added, 13.9 grams of DESMODUR W ® followed by the free radical initiators VAZO 52 ®, (1.7 gram) and VAZO 67 ® (1.7 gram). This organic phase was then dispersed in 450 grams of an aqueous continuous phase of 1 percent of TYLOSE ® by weight and 0.04 percent of sodium dodecylsulfate by weight. Homogenization was effected by a Brinkmann polytron operating at 1,000 rpm for 90 seconds. Shell formation was then initiated by the slow addition over 30 minutes of two difunctionalized diamines, 3.1 grams of DYTEK A ® and 10.6 grams of JEFFAMINE D400 ® (an amine di-terminated polyethylene oxide of molecular weight 400). Polymerization of the core monomers was then initiated by raising the temperature to 85° C. and holding that temperature for 8 hours. The batch was then cooled to room temperature, about 25° C., and the particles isolated by centrifugation at 3,000 rpm for 20 minutes. The particles were then washed with warm water and reisolated by centrifugation. The washing sequence was repeated a total of three times. Drying of the resulting encapsulated toner particles was accomplished by freeze drying. They had the following physical properties:

Core: styrene (29)/n-lauryl methacrylate (13)/n-butyl methacrylate (58)

Shell: 20 weight percent of DESMODUR W-JD 400 ® DYTEK A ®, a polyurea.

The average particle size was 5.6 microns and the GSD (size distribution) was 1.38.

EXAMPLE III

Introduction of the Fluorescent Component into the Toner:

8.5 Grams of the toner of Example I were dispersed by sonication for 2 minutes in 100 milliliters of a 0.25 weight percent aqueous solution of sodium dodecyl sulfate. A dye emulsion was simultaneously prepared by sonicating 0.25 gram of the IR fluorescer, 3,3'-diethyltricarbocyanine iodide, available from Eastman Kodak, dissolved in 15 milliliters of trichloroethane in 100 milliliters of 0.25 percent aqueous sodium dodecyl sulfate. The toner dispersion and dye emulsion were combined and stirred together for 5 hours after which the toner was isolated by filtration, washed with water and dried by freeze drying. The overall toner physical properties were not changed in any substantive way as compared to the toner of Example I except for the optical properties thereof.

EXAMPLE IV

Imaging and Detection of Fluorescence:

A developer was prepared with the toner of Example III, 3 weight percent, and carrier beads comprised of 100 microns average diameter Hoeganoes steel powder coated with 0.14 weight percent of KYNAR 301 ® and images were prepared on paper using an electrostatic imaging device know as a Levy cascade developer. Images were fused in a hot roll fuser operated at 150° C. with a dwell time of 300 milliseconds. The resultant document was scanned using a Spex Fluorolog Emission Spectrometer at an excitation wavelength of 700 nanometers while the emitted radiation from the document was monitored from about 700 to about 900 nanometers. A strong emission peak extending from about 750 to about 850 nanometers was observed having a peak value at about 800 nanometers.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the authentication of documents consisting essentially of generating developed documents in an electrophotographic apparatus, or in a laser printer with an encapsulated toner comprised of a core comprised of polymer, an optional pigment, and an infrared emitting component, and thereover a polymeric shell; and subjecting the document to an infrared reader whereby the infrared component is detected spectroscopically.

2. A process in accordance with claim 1 wherein the infrared component is selected from the group consisting of carbocyanines, dicarbocyanines, tricarbocyanines, tetracarbocyanines and pentacarbocyanines.

3. A process in accordance with claim 1 wherein the infrared component is present in an amount of from about 0.01 to about 2 weight percent.

4. A process in accordance with claim 1 wherein the core polymer is a styrene acrylate, a styrene methacrylate, a styrene-butadiene or a polyester.

5. A process in accordance with claim 1 wherein the pigment is cyan, magenta, red, yellow, green, brown, blue or mixtures thereof.

6. A process in accordance with claim 1 in which the toner is unpigmented and substantially invisible to the naked eye.

7. A process in accordance with claim 1 wherein the shell is comprised of a polymer prepared by interfacial polymerization.

8. A process in accordance with claim 1 wherein the core polymer is derived from the polymerization of addition monomers selected from the group consisting of methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, and substituted styrenes.

9. A process in accordance with claim 1 wherein the toner contains surface additives.

10. A process in accordance with claim 9 wherein the surface additives are metal salts, metal salts of fatty acids, or colloidal silicas.

11. A process in accordance with claim 9 wherein the surface additives are present in an amount of from about 0.1 to about 5 weight percent.

12. A process for avoiding the copying of documents consisting essentially of generating said documents entirely or in selected areas with the encapsulated toner of claim 1, and thereafter scanning the reflected light from the document whereby there is detected spectroscopically the infrared emitting fluoresce component, which component absorbs visible light.

13. A process in accordance with claim 12 wherein the documents are tickets, identification badges, passes, or negotiable securities.

14. A process for determining the authenticity of documents which comprises generating documents in an electrophotographic apparatus, wherein latent images are initially formed followed by development with an encapsulated toner comprised of a core comprised of a polymer, pigment particles, and an infrared emitting dye selected from the group consisting of 3,3'-diethylthiatricarbocyanine, 5,5'-dichloro-11-diphenylamino-3,3'-diethyl- 10, 12'-ethylene-thiatricarbocyanine perchlorate, and anhydro-11-(4-ethoxycarbonyl-1-piperazinyl)-10,12-ethylene-3,3,3', 3'-tetraethyl- 1,1 '-di(3-sulopropyl)-4,5,4',5'-dibenzoindotricarbocyanine hydroxide, and thereover a polymeric shell; transferring the images developed to a supporting substrate, and fusing the images thereto; and subjecting the documents formed to an infrared reader whereby the infrared dye component is detected by measuring the emitted infrared light from the toned area.

15. A process in accordance with claim 1 wherein the pigment is magnetite or cyan, yellow, magenta, or mixtures thereof.

16. A process in accordance with claim 2 wherein the infrared component is 3,3'-diethylthiatricarbocyanine, 5,5'-dichloro-11-diphenylamino-3,3'-diethyl- 10, 12'-ethylene-thiatricarbocyanine perchlorate, anhydro-11-(4-ethoxycarbonyl-1-piperazinyl)-10, 12-ethylene3,3,3', 3'-tetraethyl- 1,1 '-di(3-sulopropyl)-4,5,4', 5'-dibenzoindotricarbocyanine hydroxide, triethylammonium salt, fluorescing phthalocyanine dyes or fluorescing pigments.

17. A process in accordance with claim 1 wherein the infrared component emits light in the wavelength range from about 700 to about 1,500 nanometers.

18. A process in accordance with claim 1 in which the infrared emitting component is introduced as a component of the encapsulated toner core composition prior to the encapsulation thereof.

19. A process in accordance with claim 1 wherein the infrared emitting component is introduced into the toner by the surface treatment thereof.

20. A process in accordance with claim 2 wherein magnesium phthalocyanine, azine dyes and chlorophylls are selected as the infrared component.

21. A process for the authentication of documents consisting essentially of generating developed documents with an encapsulated toner comprised of a core comprised of polymer, a pigment and an infrared emitting component, and thereover a polymeric shell; and subjecting the document to an infrared reader.

22. A process in accordance with claim 1 wherein said infrared emitting component is selected from the group consisting of 3,3'-diethylthiatricarbocyanine, 5,5'-dichloro- 11-diphenylamino-3,3'-diethyl-10,12'-ethylene-thiatricarbocyanine perchlorate, and anhydro-11-(4-ethoxycarbonyl- 1-piperazinyl)-10, 12-ethylene-3,3,3',3'-tetraethyl-1,1'-di(3-sulopropyl)-4,5,4', 5'-dibenzoindo-tricarbocyanine hydroxide.

23. A process in accordance with claim 1 wherein the infrared component is present in an amount of from between about 0.001 and about 5 weight percent.

24. A process in accordance with claim 14 wherein the infrared emitting dye is present in an amount of from about 0.01 to about 2 weight percent.

* * * * *